US009782688B2

(12) United States Patent
Cummings

(10) Patent No.: US 9,782,688 B2
(45) Date of Patent: Oct. 10, 2017

(54) LINKABLE TOY ELEMENTS WITH ENHANCED ACOUSTIC PROPERTIES

(71) Applicant: KMA Concepts Limited, Tsim Sha Tsui, Kowloon (HK)

(72) Inventor: Peter John Cummings, Kowloon (HK)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 0 days.

(21) Appl. No.: 14/922,105

(22) Filed: Oct. 23, 2015

(65) Prior Publication Data

US 2017/0113157 A1 Apr. 27, 2017

(51) Int. Cl.

| | |
|---|---|
| ***A63H 3/16*** | (2006.01) |
| ***A63H 33/06*** | (2006.01) |
| ***A63H 5/00*** | (2006.01) |
| ***A63H 3/20*** | (2006.01) |

(52) U.S. Cl.

CPC ..... *A63H 33/062* (2013.01); *A63H 3/16* (2013.01); *A63H 3/20* (2013.01); *A63H 5/00* (2013.01)

(58) Field of Classification Search

CPC ..... A63H 5/00; A63H 3/16; A63H 3/20
USPC ..... 446/97, 100, 102, 104, 116, 120, 124
See application file for complete search history.

(56) References Cited

U.S. PATENT DOCUMENTS 2,297,813 A * 10/1942 Stork ..... F16G 13/10 198/840
2,565,823 A * 8/1951 Pool ..... A63H 33/084 446/125
3,034,254 A 5/1962 Christiansen
3,138,895 A 6/1964 Gausewitz
3,139,698 A * 7/1964 Arnold ..... A63H 33/084 446/124
3,496,670 A * 2/1970 Ryan ..... A63H 33/088 446/104
3,774,339 A 11/1973 Swett
4,789,369 A 12/1988 Lyman
5,172,534 A 12/1992 Milner et al.
5,209,693 A * 5/1993 Lyman ..... A63H 33/042 403/157
5,538,452 A * 7/1996 Kurani ..... A63H 33/04 446/102
5,797,784 A * 8/1998 Wolfe ..... A63H 33/062 403/326

(Continued)

*Primary Examiner* — Vishu Mendiratta
(74) *Attorney, Agent, or Firm* — LaMorte & Associates P.C.

(57) ABSTRACT

A toy construction set that enables modular toy elements to be interconnected into a chain assembly. Each toy element has a pivot hub that defines an empty first interior chamber. A first yoke arm is coupled to the pivot hub that defines an empty second interior chamber. A second yoke arm is coupled to the pivot hub that defines an empty third interior chamber. The first interior chamber, the second interior chamber and the third interior chamber intersect form an internal resonance chamber. Formations are present on first yoke arm, the second yoke arm, and the pivot hub. The formations intermesh and enable different modular toy elements to snap together. The formations also generate noise as two interconnected toy elements are moved in relation to one another. The noise that is generated is enhanced by the resonance chambers within the toy elements that create the noise.

12 Claims, 3 Drawing Sheets

(56) References Cited

U.S. PATENT DOCUMENTS

| | | | | |
|---|---|---|---|---|
| 6,173,832 | B1 * | 1/2001 | Cockayne | B65G 17/086 198/852 |
| 6,250,459 | B1 * | 6/2001 | Coen | B65G 17/086 198/852 |
| 6,494,763 | B1 * | 12/2002 | Hastey | A63H 3/46 446/376 |
| D516,135 | S * | 2/2006 | Kim | D21/503 |
| D635,445 | S * | 4/2011 | Foresman | D8/354 |
| 2003/0064656 | A1 * | 4/2003 | Johnson | A45C 1/12 446/8 |

* cited by examiner

LINKABLE TOY ELEMENTS WITH ENHANCED ACOUSTIC PROPERTIES

BACKGROUND OF THE INVENTION

1. Field of the Invention

In general, the present invention relates to toy construction elements that are designed to interconnect into chains. More particularly, the present invention relates to toy construction elements that are designed to produce noise as they are connected into chains and manipulated.

2. Prior Art Description

Toy construction sets with plastic parts that interconnect are well known in the toy industry. Most such construction sets are designed with blocks that interconnect in a static manner. Such building blocks are exemplified by the Lego® lines of building blocks. Still other building sets interconnect parts at joints. In this manner, the parts can be interconnected to create flexible chains. Such building sets are exemplified by U.S. Pat. No. 5,172,534 to Milner, entitled Chainable Building Blocks.

The construction toy design of U.S. Pat. No. 5,172,534 has been commercialized and has been sold under the trademark Kilxx® for the last two decades. The Klixx trademark is now owned by KMA Concepts, the applicant herein.

Much of the play value of the Klixx® line of toys is that the construction parts make an audible click as the individual parts are interconnected into chains. The interconnected parts also make audible clicks as the chains are manipulated and the individual parts of the chain move in relation to one another. However, the clicks made by the toys are subtle and have a relatively low volume. The clicks are therefore difficult to hear, especially if the toy is being played with in a noisy environment.

The present invention is an improvement upon the toy design shown in U.S. Pat. No. 5,172,534. In the improvement, the structure of the toy elements is altered in order to enhance the acoustics of the toy. In this manner, the toy produces loud, clear noises when parts are either interconnected or manipulated while connected. The design that leads to the improved acoustics is described and claimed below.

SUMMARY OF THE INVENTION

The present invention is a toy construction set that enables modular toy elements to be interconnected into a chain assembly. Each of the modular toy elements has the same shape and size. Each of the modular toy elements has a pivot hub that defines an empty first interior chamber. The first interior chamber is interposed between a first surface and a second surface of the pivot hub. The first surface and the second surface are parallel.

A first yoke arm is coupled to the pivot hub. The first yoke arm defines an empty second interior chamber. The first yoke arm has a first flat surface.

A second yoke arm is coupled to the pivot hub. The second yoke arm defines an empty third interior chamber. The second yoke arm has a second flat surface. The first interior chamber, the second interior chamber and the third interior chamber interconnect within the modular toy element. The first flat surface of the first yoke arm and the second flat surface of the second yoke arm are parallel to each other and orient at a perpendicular to both the first surface and the second surface of the pivot hub.

A gap space separates the first flat surface of the first yoke arm from the second flat surface of the second yoke arm.

Formations are present on the first flat surface of the first yoke arm, the second flat surface of the second yoke arm, the first surface of the pivot hub and the second surface of the pivot hub. The formations on the first flat surface of the first yoke arm and the second flat surface of the second yoke arm are sized and positioned to be able to intermesh with formations on the first surface and the second surface of the pivot hub.

The formations enable different modular toy elements to snap together. The formations also generate noise as two interconnected toy elements are moved in relation to one another. The noise that is generated is enhanced by the resonance chambers within the toy elements that create the noise.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
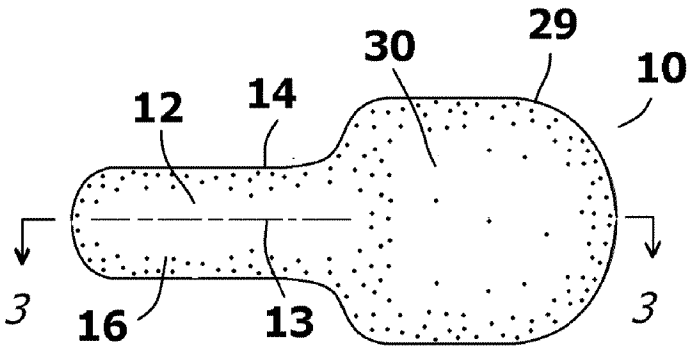
FIG. 1 is a front view of an exemplary embodiment of a modular toy element.
Figure 3:
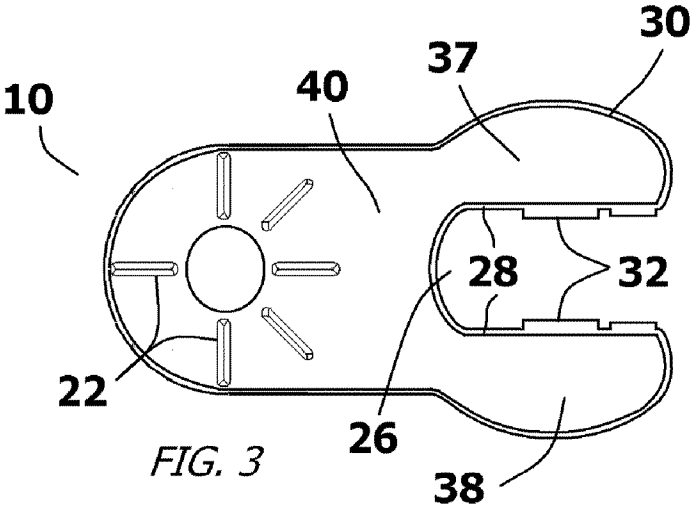
FIG. 3 is a cross-sectional view of the exemplary embodiment of a modular toy element, viewed along section line 3-3 of FIG. 1.
Figure 2:
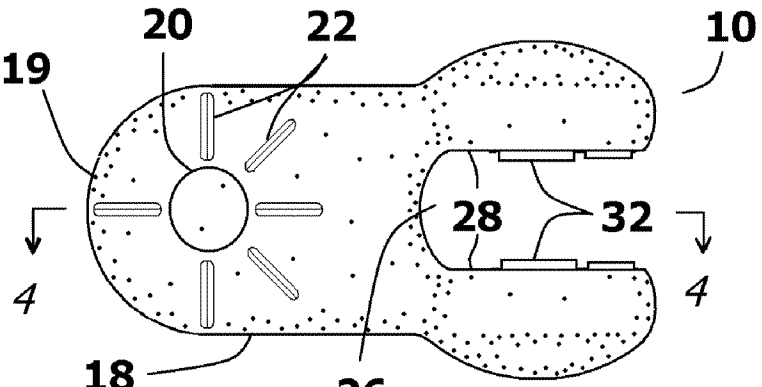
FIG. 2 is a top view of the exemplary embodiment of a modular toy element shown in FIG. 1.
Figure 4:
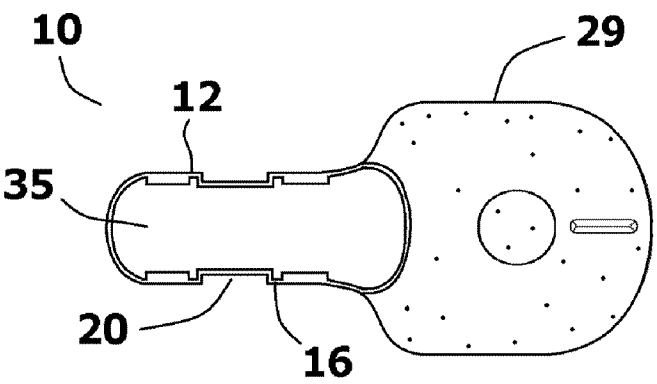
FIG. 4 is a cross-sectional view of the exemplary embodiment of a modular toy element, viewed along section line 4-4 of FIG. 2.

Although the present invention construction toy can be embodied in many ways, only one exemplary embodiment has been selected for illustration and discussion. The illustrated embodiment is merely exemplary and should not be considered a limitation when interpreting the scope of the appended claims.

Referring in unison to FIG. 1, FIG. 2, FIG. 3 and FIG. 4, a modular toy element 10 is shown. The modular toy element 10 has a pivot hub 12 that extends in a first plane 13. The pivot hub 12 has two parallel surfaces 14, 16 that lay on opposite sides of the pivot hub 12. The two parallel surfaces 14, 16 are mirror images of each other and are interconnected by two straight side surfaces 17, 18 and a curved side surface 19. The two parallel surfaces 14, 16 are spaced apart by the thickness of the pivot hub 12, which corresponds to the width of the side surfaces 17, 18, 19. A circular post indentation 20 is formed on both of the parallel surfaces 14, 16 proximate the center of the parallel surfaces, 14, 16. Although the two post indentations 20 are spaced apart by the thickness of the pivot hub 12, the two post indentations 20 are concentric.

A plurality of radial detents 22 are also formed in each of the parallel surfaces 14, 16 around the post indentations 20. The radial detents 22 surround the post indentations 20 in a radial pattern, wherein at least one radial detent 22 occurs every 90 degrees around the post indentation 20.

Two yoke arms 24 extend from the pivot hub 12. The yoke arms 24 extend from the side of the pivot hub 12 opposite the curved side surface 19. The two yoke arms 24 extend in parallel planes that are perpendicular to the first plane 13 of the pivot hub 12. The two yoke arms 24 are separated by a gap space 26. The gap space 26 is sized to receive the pivot hub 12 from another modular toy element with a slight inference fit. As such, the gap space 26 between the two yoke arms 24 is equal to, or just slightly smaller than, the width of the pivot hub 12.

Each yoke arm 24 has a flat surface 28 that faces the gap space 26. The two flat surfaces 28 from the two yoke arms 24 are parallel on opposite sides of the gap space 26. Each yoke arm 24 also has side surfaces 29 and a convex exterior surface 30. The side surface 29 and the convex exterior surface 30 provide the exterior of each of the yoke arms 24 with a domed shape.

Two post extensions 32 extend into the gap space 26 from the two flat surfaces 28 of the yoke arms 24. One of the post extensions 32 extends inwardly from the center of each of the two flat surfaces 28. The post extensions 32 are sized to be received within the post indentations 20 of another of the modular toy elements. Additionally, an elongated protrusion 34 extends from the flat surface 28 of the yoke arms 24 into the gap space 26. The elongated protrusion 34 extends radially from the post extension 32. The elongated protrusion 34 is sized to be received by a radial detent 22 in another of the modular toy elements.

From the figures, it can be seen that the pivot hub 12 is hollow and defines a first interior chamber 35. Furthermore, both of the yoke arms 24 are hollow and define a second and third interior chamber 37, 38. All three of the interior chambers 35, 37, 38 interconnect and form a single resonance chamber 40. The walls that define the three interior chambers 35, 37, 38 are thin plastic, having a preferred plastic thickness of between 0.3 millimeters and 0.7 millimeters. Due to this thin wall structure, the walls are capable of vibrating in response to acoustic energy that propagates through the resonance chamber 40. The thin walls, therefore, act as speaker diaphragms that help transmit sound from the resonance chamber 40 into the surrounding environment.

Figure 5:
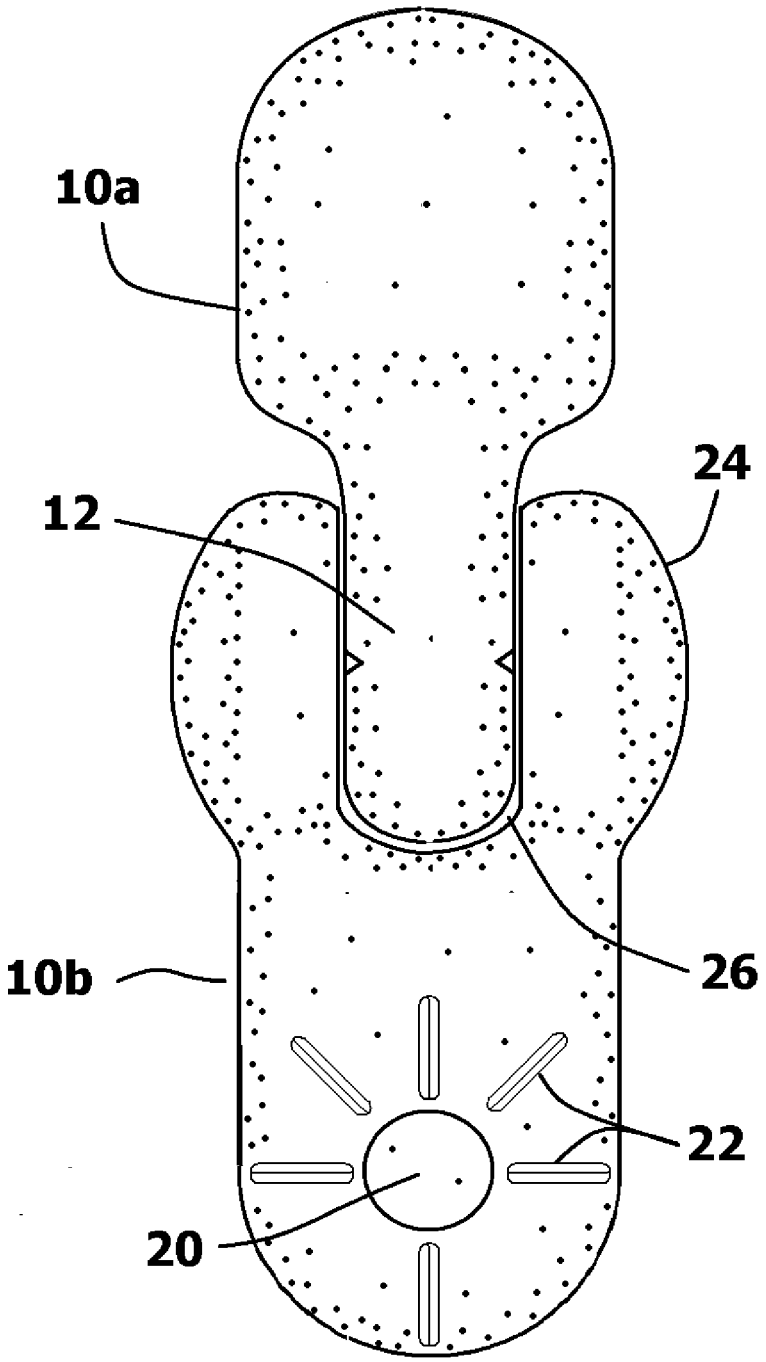
FIG. 5 shows two modular toy elements that are interconnected in a chain.

Referring to FIG. 5 in conjunction with the earlier figures, it can be seen that the modular toy elements 10*a*, 10*b* mechanically interconnect. The modular toy elements 10*a*, 10*b* interconnect by passing the pivot hub 12 of a first modular toy element 10*a* into the gap space 26 between the yoke arms 24 of another modular toy element 10*b*. There is a slight interference fit. As such, the two yoke arms 24 must spread slightly to allow for the passage of the pivot hub 12. As the pivot hub 12 enters the gap space 26, the post extensions 32 on the yoke arms 24 snap into the post indentation 20 of the pivot hub 12 with an audible snap. The sound of the snap is received within the resonance chambers 40 of both modular toy elements 10*a*, 10*b* involved in the interconnection. The resonance chambers 40 amplify the sound and make the sound louder and more pronounced than would be expected. The sound is readily transmitted into the surrounding environment due to the thin walls surrounding the resonance chambers 40.

Once the two modular toy elements 10*a*, 10*b* are interconnected, the first modular toy element 10*a* can be rotated relative the second modular toy element 10*b* and vice versa. As the first modular toy element 10*a* rotates relative the second modular toy element 10*b*, the elongated protrusions 34 on the yoke arms 24 rotate into and out of the various radial detents 22 on the pivot hub 12. This creates additional snap noises that are amplified by the resonance chambers 40. The resonance chambers 40 again amplify the sound and make the sound louder and more pronounced than would be expected. The sound is readily transmitted into the surrounding environment due to the thin walls surrounding the resonance chambers 40.

It will therefore be understood that the post indentation 20 is a feature that intermeshes with the post extension 32. A snap sound is created at the moment the features intermesh. Likewise, the radial detents 22 are features that intermesh with the elongated protrusion 34. A snap sound is created at the moment these features intermesh. The overall results are modular toy elements 10*a*, 10*b* that interconnect with a loud snap and adjust with loud snaps. This enhances the play value of the toys, especially among younger children.

Figure 6:
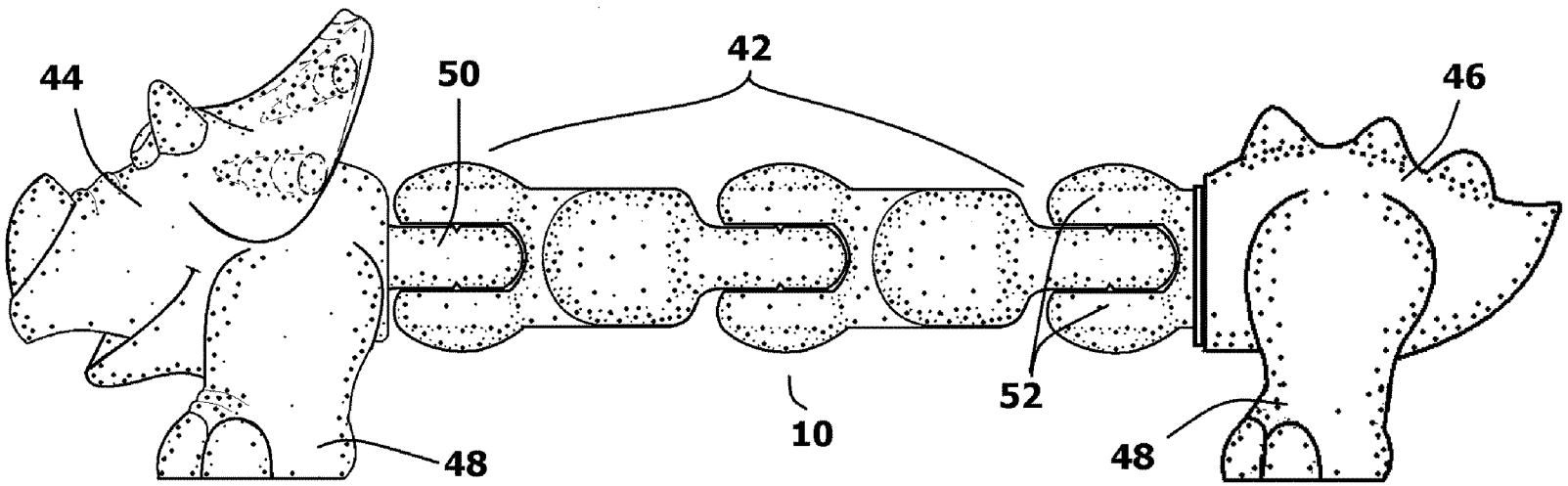
FIG. 6 shows a chain of modular toy elements suspended between two support elements to create an elongated toy character.

Referring to FIG. 6, it can be seen that long chains 42 of the modular toy elements 10 can be created. The longer the chain 42 the easier it becomes for a child to create bends and turns in the chain 42. Each time a bend or turn is created, one of the modular toy elements 10 moves relative to at least one other and a loud snap sound is created. It will therefore be understood that simply by shaking a long chain 42, the modular toy elements 10 will move and loud snap sounds will be created.

From FIG. 6, it can be seen that the chain 42 of modular toy elements 10 can be connected to support elements 44, 46 at its two free ends. In the shown embodiment, the support elements 44, 46 have the appearance of the front and rear halves of an animal. Each of the support elements 44, 46 has legs 48 that enable the support elements 44, 46 to be free standing and to retain the chain 42 at an elevated position. As such, the chain 42 of modular toy elements 10 becomes an extended body between the front and rear halves.

The support elements 44, 46 suspend the chain 42 of modular toy elements 10 at an elevation. In this manner, the modular toy elements 10 do not contact the ground or any other underlying surface. Furthermore, the support elements 44, 46 provide a child with a way to carry and manipulate the modular toy elements 10 without having to physically touch the modular toy elements 10. In this manner, when the chain is manipulated, the snap noises that are produced are not dampened by contact with the ground or contact with a child's hand. The snap noise, therefore, is projected as a loud and pronounced acoustic signal.

In the shown embodiment, the front half of the animal that forms the support element 44, has a pivot hub extension 50. The pivot hub extension 50 is sized and shaped to be identical to the pivot hub 12 of a modular toy element 10. As such, the modular toy element 10 can interconnect with the pivot hub extension 50 in the same manner that they can attach to the pivot hub 12 of another modular toy assembly 10.

The rear half of the animal that forms the support elements 46, has yoke arms extensions 52. The pivot hub extension 50 is sized and shaped to be identical to the yoke arms 24 of a modular toy element 10. As such, the modular toy element 10 can interconnect with the yoke arm extensions 52 in the same manner that they can attach to the yoke arms of another modular toy assembly 10.

It will be understood that the embodiment of the present invention that is illustrated and described is merely exemplary and that a person skilled in the art can make many variations to that embodiments. For instance, the support elements can be configured as an animal or as an object, such as a car. The number of modular toy elements connected into a chain is a matter of play choice by a child. All such embodiments are intended to be included within the scope of the present invention as defined by the claims.

What is claimed is:

1. A modular toy element, comprising:

a pivot hub that defines an empty first interior chamber, said first interior chamber being interposed between a first surface and a second surface of said pivot hub, wherein said first surface and said second surface are parallel;

a first yoke arm coupled to said pivot hub, wherein said first yoke arm defines an empty second interior chamber, wherein said first yoke arm has a first flat surface;

a second yoke arm coupled to said pivot hub, wherein said second yoke arm defines an empty third interior chamber, wherein said second yoke arm has a second flat surface, wherein said first interior chamber, said second interior chamber and said third interior chamber interconnect within said modular toy element to form a single resonance chamber, and wherein said first flat surface of said first yoke arm and said second flat surface of said second yoke arm are parallel to each other and perpendicular to both said first surface and said second surface of said pivot hub;

a gap space separating said first flat surface of said first yoke arm from said second flat surface of said second yoke arm;

formations on said first flat surface of said first yoke arm, said second flat surface of said second yoke arm, said first surface of said pivot hub and said second surface of said pivot hub, wherein said formations on first flat surface of said first yoke arm and said second flat surface of said second yoke arm are sized and positioned to be able to intermesh with said formations on said first surface and said second surface of said pivot hub.

2. The modular toy element according to claim 1, wherein each of said yoke arms has a convex exterior surface.

3. The modular toy element according to claim 2, wherein each said convex exterior surface is molded from plastic no greater than 0.7 millimeters thick.

4. The modular toy element according to claim 1, wherein said gap space is sized to receive and retain said pivot hub.

5. A toy assembly, comprising:

a plurality of interconnectable toy elements that include a first modular toy element and a second modular toy element;

said first modular toy element including a first pivot hub and a first set of yoke arms coupled to said first pivot hub, wherein a first gap space exists between said first set of yoke arms, and wherein said first pivot hub defines a first interior chamber and said first set of yoke arms define secondary interior chambers that interconnect with said first interior chamber to define a first internal resonance chamber within said first modular toy element;

said second modular toy element including a second pivot hub and a second set of yoke arms coupled to said second pivot hub, wherein a second gap space exists between said second set of yoke arms, and wherein said second modular toy element is hollow and defines a second internal resonance chamber;

wherein said second pivot hub from said second modular toy is received in said first gap between said first set of yoke arms of said first modular toy;

formations on said second pivot hub and said first set of yoke arms that temporarily intermesh and create audible sounds as said second pivot hub is rotated between said first set of yoke arms, wherein said audible sounds are enhanced by said first internal resonance chamber and said second internal resonance chamber.

6. The assembly according to claim 5, further including supports that attach to said plurality of interconnectable toy elements, wherein said plurality of interconnectable toy elements are suspended at an elevation between said supports.

7. The assembly according to claim 6, wherein said supports are configured as two parts of a standing character.

8. The assembly according to claim 5, wherein said second pivot hub has part of said second internal resonance chamber interposed between a first surface and a second surface of said second pivot hub, wherein said first surface and said second surface are parallel.

9. The assembly according to claim 8, wherein said first set of yoke arms have parallel flat surfaces that face said first gap space on opposite sides of said first gap space.

10. The assembly according to claim 9, wherein said parallel flat surfaces are perpendicular to both said first surface and said second surface of said second pivot hub.

11. The assembly according to claim 5, wherein each of said first set of yoke arms has a convex exterior surface.

12. The assembly according to claim 11, wherein each said convex exterior surface is molded from plastic no greater than 0.7 millimeters thick.

* * * * *